US009120347B1

(12) United States Patent
Mock

(10) Patent No.: US 9,120,347 B1
(45) Date of Patent: Sep. 1, 2015

(54) ERGONOMIC WRITING INSTRUMENT

(71) Applicant: Craig C. Mock, Dodge City, KS (US)

(72) Inventor: Craig C. Mock, Dodge City, KS (US)

( * ) Notice: Subject to any disclaimer, the term of this patent is extended or adjusted under 35 U.S.C. 154(b) by 0 days.

(21) Appl. No.: 14/587,447

(22) Filed: Dec. 31, 2014

(51) Int. Cl.

| | |
|---|---|
| ***B43K 23/008*** | (2006.01) |
| ***B43K 7/00*** | (2006.01) |
| ***B43K 8/00*** | (2006.01) |
| ***B43K 21/00*** | (2006.01) |
| *B43K 23/004* | (2006.01) |
| *B43K 23/012* | (2006.01) |

(52) U.S. Cl.
CPC ..... *B43K 23/008* (2013.01); *B43K 7/005* (2013.01); *B43K 8/003* (2013.01); *B43K 21/006* (2013.01); *B43K 23/004* (2013.01); *B43K 23/012* (2013.01)

(58) Field of Classification Search
CPC combination set(s) only.
See application file for complete search history.

(56) References Cited

U.S. PATENT DOCUMENTS

| | | | | |
|---|---|---|---|---|
| 1,367,872 | A | 2/1921 | Glaesser | |
| 4,508,464 | A | 4/1985 | Money | |
| 4,568,213 | A | 2/1986 | Money | |
| 5,413,428 | A | 5/1995 | Kageyama | |
| 6,464,419 | B1 | 10/2002 | Chan | |
| 7,316,516 | B2 * | 1/2008 | Regala | 401/6 |

OTHER PUBLICATIONS

U.S. Appl. No. 14/053,138, filed Oct. 14, 2013, Mock (same as instant).
U.S. Appl. No. 14/532,924, filed Nov. 4, 2014, Mock (same as instant).
U.S. Appl. No. 14/587,369, filed Dec. 31, 2013, Mock (same as instant).

* cited by examiner

*Primary Examiner* — David Walczak
(74) *Attorney, Agent, or Firm* — Kenneth H. Jack; Davis & Jack, L.L.C.

(57) ABSTRACT

An ergonomic writing instrument having longitudinal and oppositely longitudinal ends, the writing instrument having a T body including a column having upper and lower ends, a lateral arm having proximal and distal ends, and an oppositely lateral arm having proximal and distal ends; lateral and oppositely lateral column plates, each plate among the lateral and oppositely lateral column plates having upper and lower ends, the T body's column consisting of the lateral and oppositely lateral column plates; lateral and oppositely lateral hinges respectively interconnecting the lateral column plate's upper end and the lateral arm's proximal end and the interconnecting oppositely lateral column plate's upper end and the oppositely lateral arm's proximal end; and a ballpoint pen fixedly mounted at the lateral and oppositely lateral arms' proximal ends.

7 Claims, 3 Drawing Sheets

ERGONOMIC WRITING INSTRUMENT

The inventor and applicant named in the instant application is the same person as the inventor and applicant named in U.S. patent application Ser. Nos. 14/053,138, 14/532,924, and 14/587,369 filed respectively on Oct. 14, 2013, Nov. 4, 2014, and on Dec. 31, 2014, and respectively entitled "Writing Instrument", "Writing Instrument", and "Ergonomic and Collapsible Writing Instrument". Said previously filed patent applications remain pending at the date of filing of the instant application.

FIELD OF THE INVENTION

This invention relates to writing instruments such as pens, markers, and pencils. More particularly, this invention relates to such writing instruments whose body portions are adapted for ergonomic grasping and holding by the fingers of a writer's hand.

BACKGROUND OF THE INVENTION

Pens and pencils having a barrel shaped body or cylindrical body are often grasped between the thumb, index and middle fingers of a writer's hand. During such writing use, the tip of the index finger, the tip of the thumb, and the proximally lateral side of the writer's middle finger are typically placed over contact points arrayed at approximately 120° circumferential intervals about the instrument's cylindrical body. Such common writing instrument holding technique, when applied to a common cylinder bodied pen, often undesirably and unergonomically allows the body of the pen to roll over its points of contact with the writer's fingers, resulting in instability during writing.

The instant inventive writing instrument solves or ameliorates such problems, difficulties and deficiencies inherent in and arising during the use of common barrel body configured pens and pencils, by specially configuring the body of the writing instrument to approximate the shape and lateral cross-sectional profile of a T bar or T beam, wherein the column portion of such T bar configured body comprises lateral and oppositely lateral panels or plates whose upper ends are hingedly attached at the proximal ends of the arms of the T. Such specialized configuration advantageously allows the instrument to ergonomically present fingertip receiving valleys during use for writing, and to alternatively compactly collapse for storage.

BRIEF SUMMARY OF THE INVENTION

A first structural component of the instant inventive ergonomic writing instrument comprises a T body which may be composed of plastic and whose lateral cross-sectional shape approximates that of a common structural T bar or beam. Just as a capital letter T has a lower column portion and has upper cantilevering right and left or lateral and oppositely lateral arms, the lateral cross-sectional shape of the body component of the instant inventive instrument includes column, lateral arm, and oppositely lateral arm portions. While configured for writing use, the instant inventive writing instrument present V shaped valleys which are formed and bounded by the T's arms and column. Such valleys advantageously receive and ergonomically hold and position the fingertips of a writer's hand during writing use of the inventive instrument.

Further structural components of the instant inventive writing instrument comprise lateral and oppositely lateral column plates. In the preferred embodiment, the T body's column portion comprises such plates, and the cumulative thickness of the lateral and oppositely lateral column plates preferably equals the lateral thickness of the column. In the preferred embodiment, the longitudinal dimension of the lateral and oppositely lateral column plates is substantially equal to the longitudinal dimension of the T body's lateral and oppositely lateral arms.

Further structural components of the instant inventive writing instrument comprise lateral and oppositely lateral pivoting means which respectively interconnect the lateral column plate's upper end and the lateral arm's proximal end, and interconnect the oppositely lateral column plate's upper end and the oppositely lateral arm's proximal end. Such pivoting means are preferably adapted for facilitating movements of the lateral and oppositely lateral column plates to collapsed positions at which they respectively underlie and co-extend with the T's lateral and oppositely lateral arms. The pivoting means also facilitate counter-pivoting movements of the lateral and oppositely lateral column plates to writing use positions at which they substantially perpendicularly extend from the lateral and oppositely lateral arms' proximal ends. While in their writing use positions, the lateral and oppositely lateral column plates' distal or lower ends approach and stop against each other at the instrument's medial plane of bilateral symmetry.

In a preferred embodiment, the lateral and oppositely lateral pivoting means comprise a longitudinally extending series of snag lug and snap socket hinges. Suitably, pin and sleeve hinges may be alternatively used. Also suitably, living hinges may be alternatively used.

Further structural components of the instant inventive writing instrument comprise scribing means which are fixedly mounted or supported at the instrument's mid-line and are substantially located at the proximal ends of the T body's lateral and oppositely lateral arms. The scribing means may suitably comprise a combination of a hollow bore formed at such arm proximal ends in combination with a ballpoint pen and ink cartridge line drawing implement which is received within such bore. Other scribing means falling within the scope of the invention, and which may be suitably substituted, comprise mechanical pencils, felt-tip pens, felt-tip markers, paint pens, and touch screen styluses.

In use of the instant inventive ergonomic writing instrument, the lateral and oppositely lateral column plates which form the T body's column portion may be manually pivotally moved between writing positions and collapsed positions. Upon pivoting to their writing positions, the lateral and oppositely lateral column plates form lateral and oppositely lateral V channels at the lateral and oppositely lateral aspects of the T body. Such V channels ergonomically serve as fingertip receiving recesses which facilitate secure holding of the writing instrument's body. Lateral and oppositely lateral counter-pivoting of the lateral and oppositely lateral column plates co-extends those plates with the T body's arms, advantageously compactly configuring the writing instrument for storage within, for example, the writer's shirt pocket.

Accordingly, objects of the instant invention include the provision of an ergonomic instrument which incorporates structures, as described above, and which arranges those structures in relation to each other in manners described above for the performance of the beneficial functions described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figures 1, 2, 3, 4:
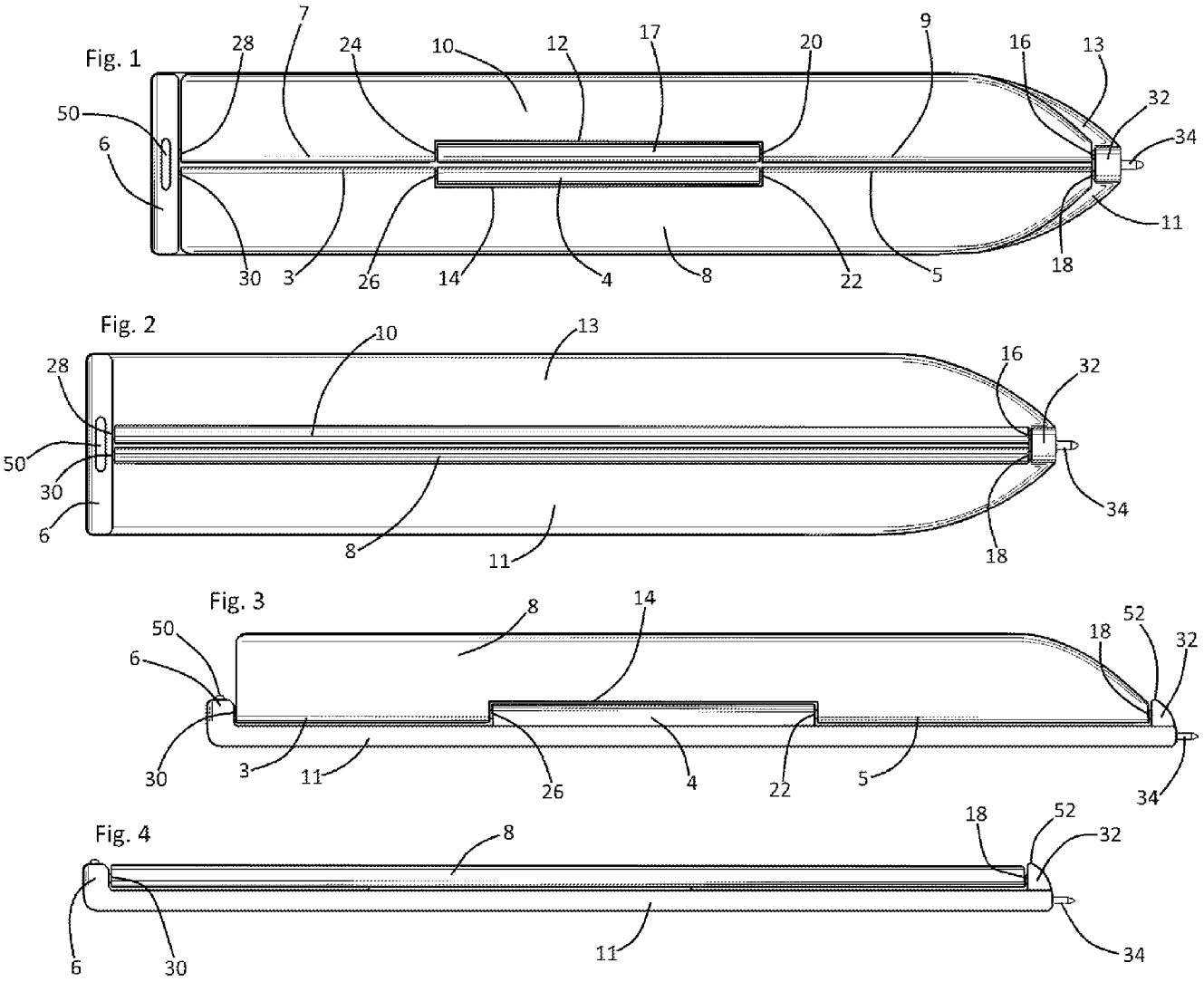
FIG. 1 is a plan view of the instant inventive ergonomic writing instrument, the view showing the instrument in a collapsed storage configuration.
FIG. 2 redepicts the structure of FIG. 1, the view of FIG. 2 showing the instrument re-configured in a writing use configuration.
FIG. 3 is a side view of the structure depicted in FIG. 2.
FIG. 4 is a side view of the structure depicted in FIG. 1.

Referring now to the drawings, and in particular to Drawing FIGS. 1-4 and 9, it may be seen that the lateral cross-sectional shape of the body of the instant inventive writing instrument forms a T. In each of the figures representing the T body configuration (i.e., FIGS. 2, 3, 6, 7, and 9), the T is inverted to demonstrate a preferred holding orientation with respect to a writer's hand. While the instrument is so configured for writing use, the T cross-sectionally shaped body of the instrument constitutes a major structural and functional component of the instrument.

The column portion of the instrument's T body preferably comprises lateral and oppositely lateral column plates 8 and 10, and the arm portions of the T body comprise lateral and oppositely lateral arms 11 and 13. In the preferred embodiment, the proximal ends of the lateral and oppositely lateral arms 11 and 13 are formed wholly with each other, and at such juncture they preferably form a tubular bore 40 for service as scribing means.

Pivoting means for substantially medially positioning the upper or proximal ends of the lateral and oppositely lateral column plates 8 and 10 respectively at and beneath the proximal ends of the lateral and oppositely lateral arms 11 and 13 are preferably provided. The pivoting means preferably comprise the depicted longitudinally extending series of lateral and oppositely lateral snap lug and snap socket hinges or pivot joints. Referring in particular to FIG. 1, the lateral snap lug and snap socket hinge combination comprises hinge bases 6, 4, and 32, which nestingly receive hinge tabs 3 and 5 formed at the upper or proximal end of column plate 8. Recess 14 formed at the proximal end of plate 8 correspondingly receives base 4. Snap lug and snap socket combinations 30, 26, 22, and 18 securely and pivotally interconnect such bases and tabs 6, 3, 4, 5, and 32. The pivoting means' oppositely lateral snap lug and snap socket combinations 28, 24, 20, and 16, similarly pivotally interconnect bases 6, 17, and 32 with hinge tabs 7 and 9, and within recess 12, which are formed at the upper or proximal end of column plate 10. While the snap lug and snap socket hinge combinations depicted are preferred, they are intended as being representative of other suitably substituted hinge means or pivoting means such as pin and axle hinges and living hinges.

Figure 9:
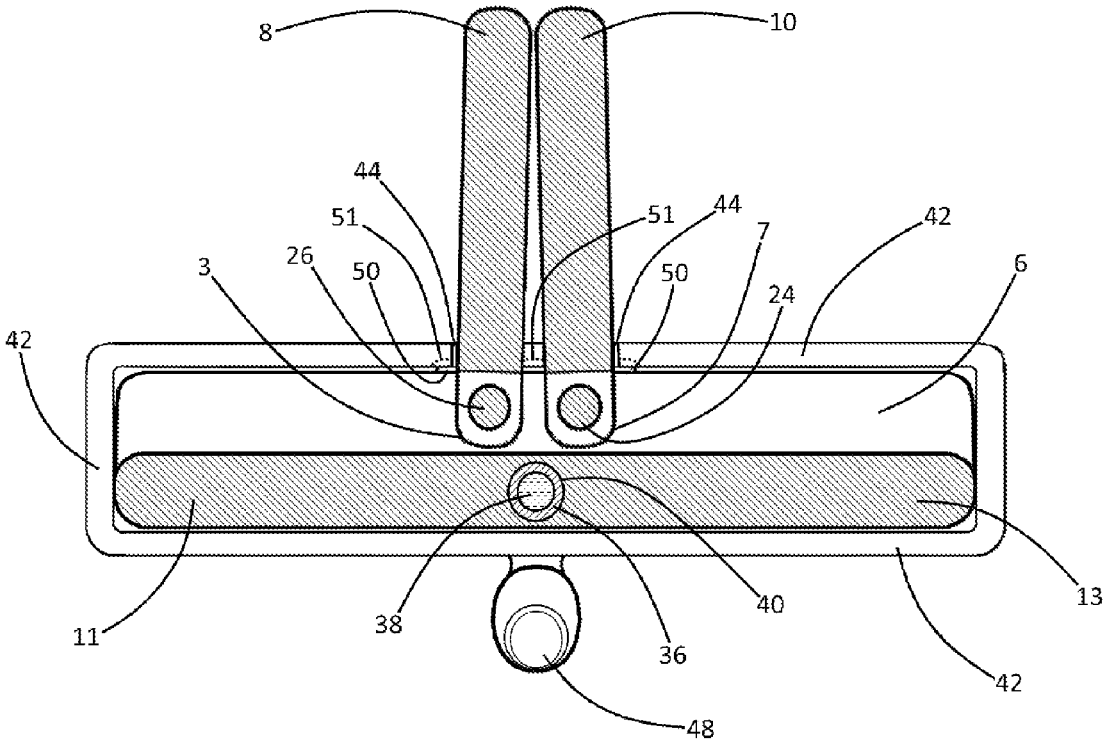
FIG. 9 is a sectional view, as indicated in FIG. 7.

Referring simultaneously to FIGS. 1 and 9, a line drawing implement comprising an ink cartridge 36 having a longitudinal ballpoint 34 and being filled with ink 38 is nestingly received within bore 40. While the depicted ballpoint pen scribing means 34,36,38,40 incorporates a preferably utilized line drawing implement, such components are intended as being representative of other suitably substituted line drawing implements such as mechanical pencils, felt-tip pens, felt-tip markers, paint pens, and touch screen styluses.

In use of the instant inventive writing instrument, the lateral and oppositely lateral column plates 8 and 10 may be freely manually pivoted between a writing use position, as depicted in FIGS. 2, 3, and 9, and a collapsed storage position, as depicted in FIGS. 1 and 4. Upon manual pivoting of the column plates 8 and 10 to their writing use positions, a pair of longitudinally extending V shaped channels or recesses are formed for secure and ergonomic receipts of a writer's index fingertip and thumbtip while writing. Alternatively, as depicted in FIGS. 1 and 4, while the writing instrument is not being used for writing, column plates 8 and 10 may be manually counter-pivoted away from each other so that they respectively splay and co-extend beneath the lateral and oppositely lateral arms 11 and 13. In the collapsed FIGS. 1 and 4 configuration, the writing instrument may be conveniently and unobtrusively stored within a writer's shirt pocket (not depicted within views).

Figure 5:
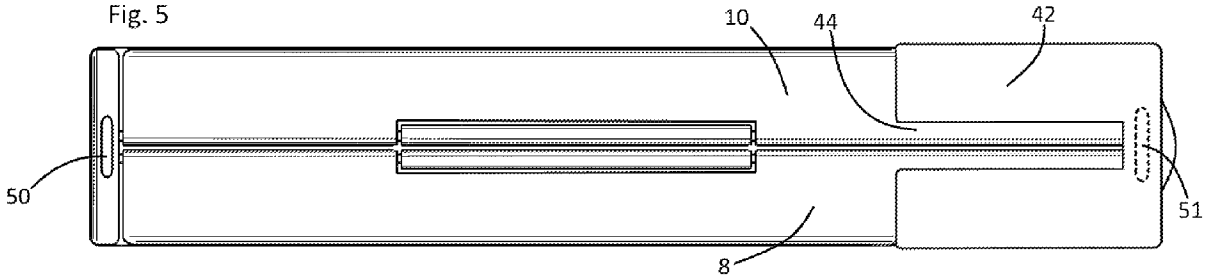
FIG. 5 redepicts the structure of FIG. 1, the view of FIG. 5 further showing a specialized cap placed over the instrument's longitudinal end.
Figure 6:
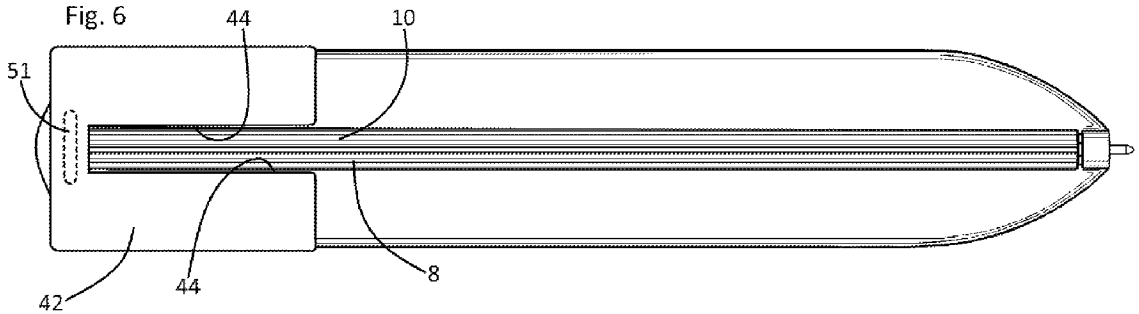
FIG. 6 redepicts the structure of FIG. 2, the view of FIG. 6 showing the specialized cap of FIG. 5 alternatively mounted over the oppositely longitudinal end of the instrument.
Figure 7:
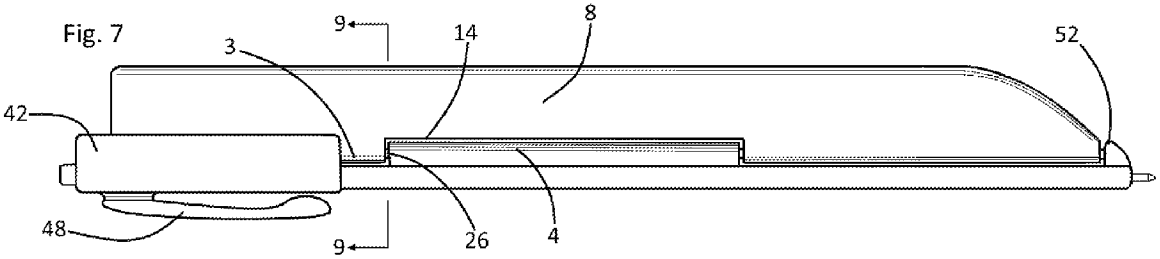
FIG. 7 is a side view of the structure depicted in FIG. 6.
Figure 8:
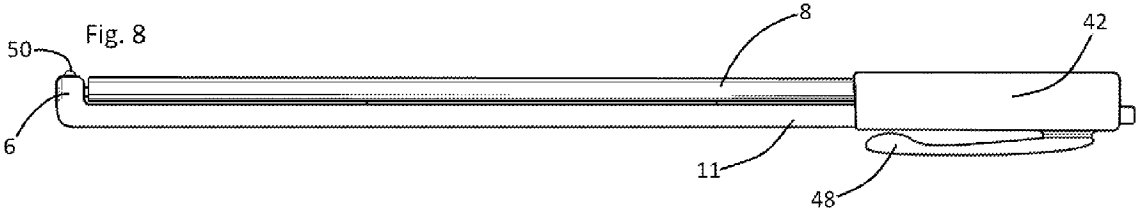
FIG. 8 is a side view of the structure depicted in FIG. 5.

Referring simultaneously to FIGS. 5-8 and 9, a specialized cap 42 may be provided, such cap preferably being fitted for alternative mounting over the longitudinal and oppositely longitudinal ends of the writing instrument. Upon fitting of the cap 42 over the longitudinal end of the writing instrument, as depicted in FIGS. 5 and 8, the lateral and oppositely lateral column plates 8 and 10 are advantageously held in their collapsed and compact storage positions. Accordingly, upon such longitudinal mounting of cap 42, the writing instrument may be securely and compactly stored within a writer's shirt pocket while pocket clip 48 engages such pocket.

Alternatively, upon removing the cap 42 form the instrument's longitudinal end, the lateral and oppositely lateral plates 8 and 10 may freely pivot from their collapsed FIGS. 5 and 8 positions to their perpendicular T column forming configurations, as depicted in FIGS. 6, 7, and 9. Thereafter, cap 42 may be re-mounted over the oppositely longitudinal end of the writing instrument, as depicted in FIGS. 6 and 7. Upon such oppositely longitudinal mounting, a fitted slot 44 which is preferably formed within the lower wall of cap 42 may advantageously receive the oppositely longitudinal ends of the column plates 8 and 10. Upon such engagement of slot 44 with column plates 8 and 10, the cap 42 may advantageously function as a retainer bracket which securely holds the column plates at their perpendicular writing use positions.

Snap lug 50 formed upon base 6 and the lower end 52 of base 32 serve, in combination with a snap socket 51 which opens at the interior of cap 42, as snap lug/snap socket releasable fastening means which alternatively hold the cap 42 upon the oppositely longitudinal and longitudinal ends of the writing instrument.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. An ergonomic writing instrument having longitudinal and oppositely longitudinal ends, said writing instrument comprising:

(a) a T body comprising a column having upper and lower ends, a lateral arm having proximal and distal ends, and an oppositely lateral arm having proximal and distal ends;

(b) lateral and oppositely lateral column plates, each plate among the lateral and oppositely lateral column plates having upper and lower ends and having longitudinal and oppositely longitudinal ends, the T body's column comprising the lateral and oppositely lateral column plates;

(c) lateral and oppositely lateral pivoting means respectively interconnecting the lateral column plate's upper end and the lateral arm's proximal end and interconnecting the oppositely lateral column plate's upper end and the oppositely lateral arm's proximal end; and (d) scribing means fixedly attached to the lateral and oppositely lateral arms' proximal ends.

2. The ergonomic writing instrument of claim 1 wherein the lateral and oppositely lateral pivoting means are adapted for facilitating movements of the lateral and oppositely lateral column plates between collapsed positions and writing positions, the lateral and oppositely lateral column plates respectively co-extending with the lateral and oppositely lateral arms upon the movements to their collapsed positions, and the lateral and oppositely lateral column plates' lower ends moving toward each other upon the movements toward the writing positions.

3. The ergonomic writing instrument of claim 2 wherein the lateral and oppositely lateral pivoting means comprise hinges selected from the group consisting of snap lug and snap socket hinges, sleeve and pin hinges, and living hinges.

4. The ergonomic writing instrument of claim 3 wherein the scribing means comprise a line drawing implement selected from the group consisting of ballpoint pens, mechanical pencils, felt-tip pens, felt-tip markers, paint pens, and touch screen styluses.

5. The ergonomic writing instrument of claim 4 further comprising a cap fitted for alternatively covering the writing instrument's longitudinally and oppositely longitudinal ends.

6. The ergonomic writing instrument of claim 5 wherein the cap has a slotted lower wall, said wall's slot being closely fitted for, upon the movements of the lateral and oppositely lateral column plates to their writing positions, receiving the lateral and oppositely lateral column plates' oppositely longitudinal ends.

7. The ergonomic writing instrument of claim 6 wherein the T body is composed of plastic.

* * * * *